US006763116B2

(12) United States Patent
Barthel et al.

(10) Patent No.: US 6,763,116 B2
(45) Date of Patent: Jul. 13, 2004

(54) HEARING AID AND OPERATING METHOD THEREFOR WITH CONTROL DEPENDENT ON THE NOISE CONTENT OF THE INCOMING AUDIO SIGNAL

(75) Inventors: Roland Barthel, Erlangen (DE); Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/253,871

(22) Filed: Sep. 24, 2002

(65) Prior Publication Data

US 2003/0076974 A1 Apr. 24, 2003

(30) Foreign Application Priority Data

Sep. 24, 2001 (DE) ..... 101 46 885

(51) Int. Cl.[7] ..... H04R 25/00
(52) U.S. Cl. ..... 381/312; 381/71.6; 381/320
(58) Field of Search ..... 381/23.1, 60, 61, 381/312, 320, 321, 314, 323, 317, 71.6, 94.1; 379/52

(56) References Cited

U.S. PATENT DOCUMENTS 4,467,145 A 8/1984 Borstel
5,604,812 A * 2/1997 Meyer ..... 381/312
5,838,806 A * 11/1998 Sigwanz et al. ..... 381/312

FOREIGN PATENT DOCUMENTS

DE OS37 33 983 4/1989
DE OS199 44 467 3/2001

* cited by examiner

*Primary Examiner*—Huyen Le
(74) *Attorney, Agent, or Firm*—Schiff Hardin LLP

(57) ABSTRACT

For improving the automatic switching and control of hearing aid devices in view of respective auditory situation, the acoustic signal picked up by the hearing aid device is analyzed for noise signals. The control of the hearing aid device then ensues on the basis of the analyzed noise signals. Individual transmission parameters or entire hearing programs of the hearing aid device can be controlled or switched.

15 Claims, 3 Drawing Sheets

HEARING AID AND OPERATING METHOD THEREFOR WITH CONTROL DEPENDENT ON THE NOISE CONTENT OF THE INCOMING AUDIO SIGNAL

BACKGROUND OF THE INVENTION

1. Field of the Invention

The present invention is directed to a hearing aid device of the type having an acoustic pick-up for picking up a noise-free or noise-containing acoustic signal and a control device for controlling hearing aid parameters. The present invention also is directed to a method for the control of a hearing aid device.

2. Description of the Prior Art

Hearing aids are utilized in a variety of auditory situations and must communicate acoustic stimuli to the patient that are appropriate for the situation. In, for example, street traffic, the wearer wants an omni-directional sound perception for perceiving danger but would like to experience a directed sound perception in a conversation with a conversation partner. Moreover, low-noise telephoning should be possible for the hearing aid user with a hard-wired as well as cordless telephones, as well as with mobile radiotelephones.

Hearing aids are usually able to respond to the different auditory situations because the hearing aid user can switch them into different hearing programs. A typical hearing program is the telephone hearing program wherein the acoustic signals that the microphone of the hearing aid picks up are filtered according to the spectrum of telephone signals in order to suppresses unwanted ambient noises in other spectral ranges. High-quality hearing aid devices usually have a number of microphones that can be interconnected by a specific hearing program in order to achieve a directional effect.

The switching or control of hearing aids usually ensues with switches, keys or controls at the housing of the hearing aid device. In behind-the-ear (BTE) hearing aid devices, this does not represent a problem because they have a larger structural size. In-the-ear (ITE) hearing aid devices, which are located in the external ear or even exclusively in the auditory canal (CIC devices; complete in the canal), the difficulty of making manual settings to the hearing aid itself arises because their structural size is so small. The ITE hearing aid devices therefore are usually automatically controlled and switched.

As is known, a hearing aid device can be automatically switched into a telephone hearing program or an auditory coil can be activated when a magnetic field that is emitted by the earphone of a telephone device is detected. In this context German PS 31 09 049 discloses that the application of a magnetic field is also required for the actuation of the switching event by using elements that change their electrical properties, for instance the conductivity, in the sense of a switch under the influence of a magnetic field. For instance, a displaceable magnet can be utilized as switch element. The actual contact elements are included in the category of non-contacting switches and, for example, can be fashioned as reed contacts or as magnetic field semiconductors that are also Hall generators. For the switch event, it is thus necessary that the hearing aid device respond to a static magnetic field so that it amplifies the inductively received signals according to the telephone hearing program.

Difficulties regularly occur in the automatic switching into a telephone hearing program when, for example in lecture halls, the signal is inductively transmitted by loops in the floor but a magnetic signal is not present. The same problem occurs with mobile and cordless telephones that have piezoelectric earphones. Moreover, the piezoelectric earphones do not transmit any usable inductive signals, so that inductive pick-ups are unsuited for this purpose in the hearing aid device.

SUMMARY OF THE INVENTION

An object of the present invention is thus comprised in improving the automatic switching and control of hearing aid devices in view of the respective auditory situation.

This object is in accordance with the invention in a hearing aid device having an acoustic pick-up for picking up a noise-free or noise-infested acoustic signal and a control device for controlling hearing aid parameters, as well as an analysis device for analyzing the acoustic signal in view of noise signals and for supplying an analysis result to the control device, so that the hearing aid device, particularly individual transmission parameters or entire hearing programs, can be controlled on the basis of the analysis result.

This object also is achieved by a method for controlling a hearing aid device by picking up a noise-free or noisy acoustic signal, analyzing the acoustic signal in view of noise signals and controlling the hearing aid, particularly individual parameters or entire hearing programs, on the basis of the analyzed noise signals.

By evaluating the noise content of the informational signal, namely the acoustic signal that carries the acoustic information, to identify pre-defined disturbances, the evaluation of a signal, for example a magnetic equisignal, to be detected by an additional pick-up device, can be foregone. Moreover, auditory situations can be distinguished with greater differentiation due to the evaluation of the noise signals due to the input of unwanted noises into the microphone of the hearing aid device or the input of electrical or magnetic disturbances into the electronics of the hearing aid device. It is thus possible to recognize telephoning with a mobile telephone on the basis of typical rhythms in the transmission of data packets.

As used herein, the term "noise content" means whatever noise is (or is not) present in the incoming audio signal, and thus in the electrical signal that is obtained therefrom. A noise-free audio signal will have a noise content of zero, however, analyzing the incoming signal to determine that it has a noise content of zero is still a relevant part of the analysis for controlling the hearing aid.

DESCRIPTION OF THE PREFERRED EMBODIMENTS

Figure 1:
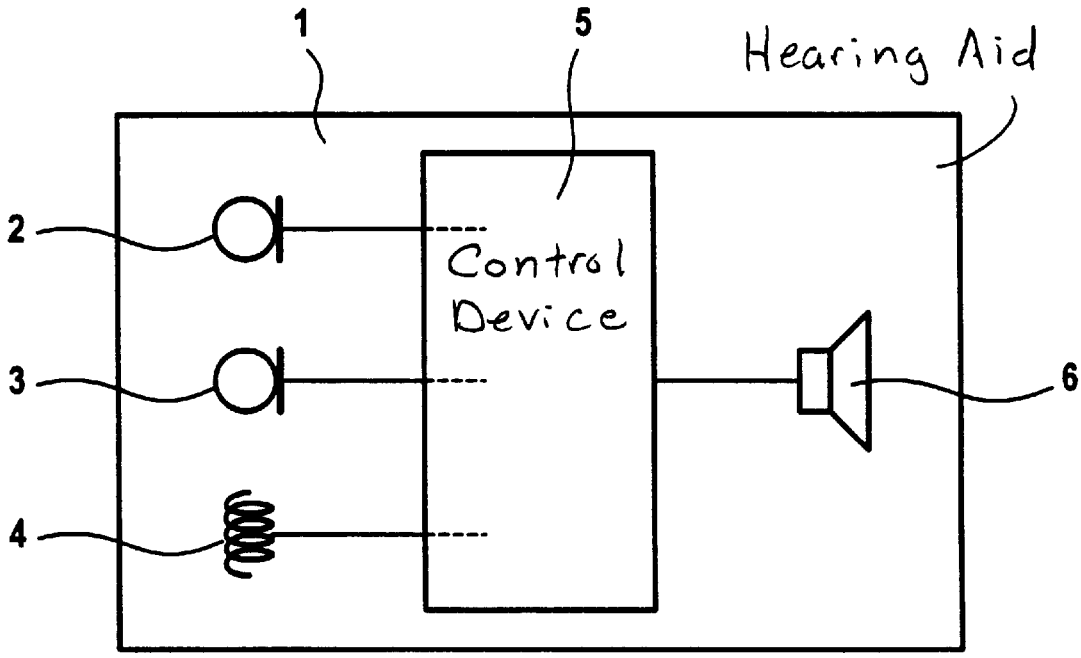
FIG. 1 schematically illustrates the structure of a hearing aid device.

As shown in FIG. 1, a digital hearing aid device 1 has two microphones 2, 3 and—optionally—an auditory coil 4. The two microphones 2, 3 pick up incoming sound and convert it for the control device 5 for further processing. The signal emitted by the induction system or a telephone coil is inductively picked up in the auditory coil or the induction pick-up 4 and is forwarded to the control device 5 for further processing. The control device 5 analyzes the signals obtained from the pick-ups 2, 3 and 4 and controls or switches the transfer function between the pick-ups 2, 3, 4 and an earphone.

Inventively, it is not the signal of a switch or a constant signal of an external device such as, for example, the static magnetic field signal of a telephone earphone coil that is employed for switching or controlling the hearing aid device or its hearing programs and/or transmission parameters. On the contrary, an externally interfering noise signal is utilized for the switching or control according to the present invention. For example, the noise signal superimposed on the acoustic informational signal can be a transmission signal of a mobile telephone that can be audible despite shielding measures in the audio domain.

Figure 2:
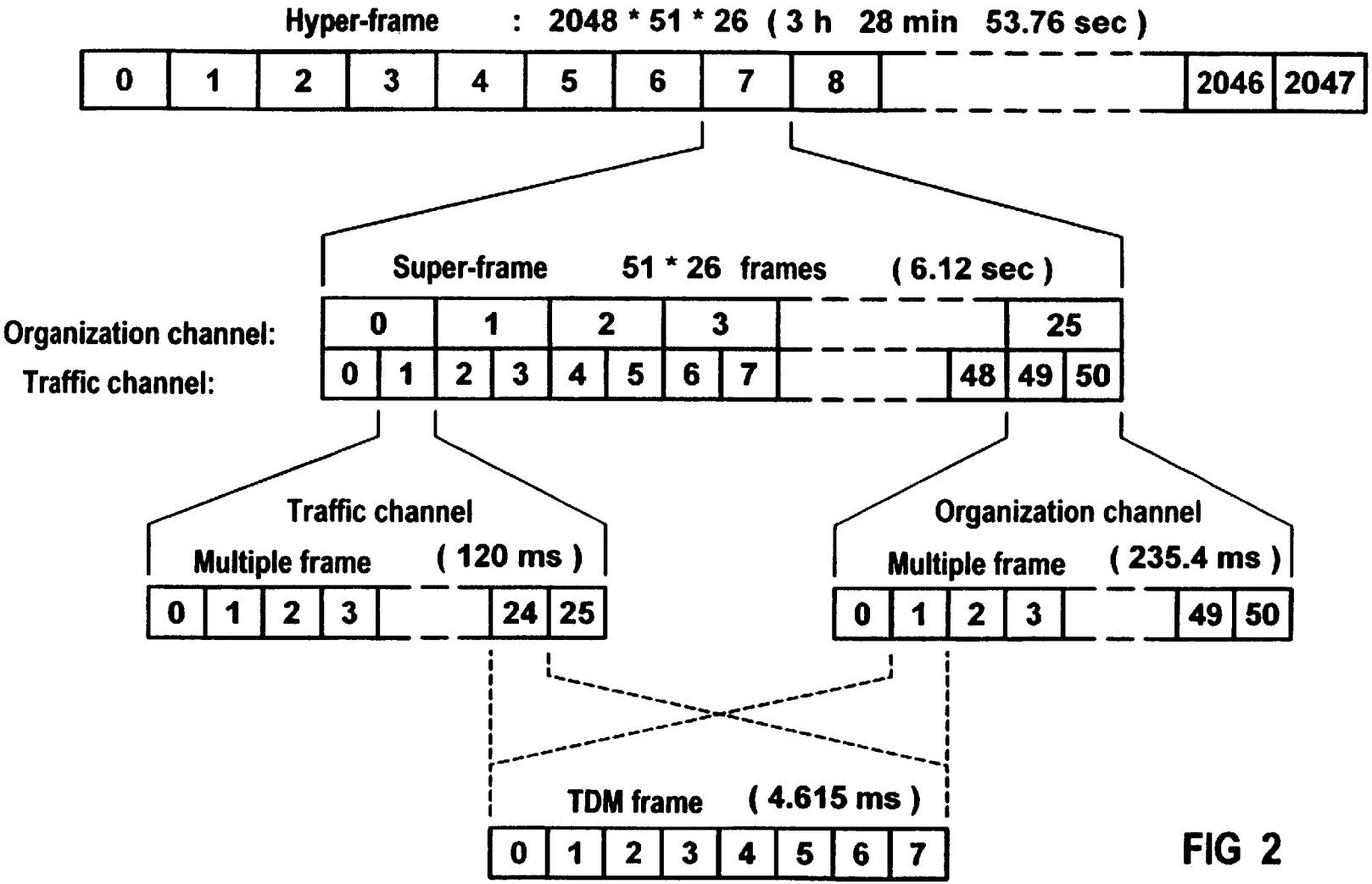
FIG. 2 shows a typical time-division multiplex frame structure.

FIG. 2 illustrates the disturbances that are produced by mobile telephones. This shows the time-division multiplex frame structure of data packets that is usually employed in mobile radiotelephone technology. The frames, accordingly, are hierarchically subdivided—proceeding from hyper-frames—into lower ranking super-frames, multiple frames and TDM frames. The frame length of multiple frames typically amounts to 120 ms in the traffic channel, to 235.4 ms in the organization channel, and that of a TDM frames typically amounts to 4.615 ms. The corresponding transmission frequencies for TDM frames lie in the audible range at about 200 Hz. Higher harmonics of the transmission frequencies of the multiple frames also lie in the audible range. When signal parts of data packets sent by the mobile telephone are electromagnetically emitted into the hearing aid device, then clearly perceptible disturbances can occur.

Wireless telephone systems use specific, defined frequency bands in which they transmit their data packets. The telephone standard DECT for cordless telephones, for example, covers transmission frequencies between 1880 and 1900 MHz. The transmission of a data packet in the DECT telephone standard lasts approximately 417 $\mu$s. The individual data packets are transmitted grouped into 10 ms intervals.

The digital D=network for mobile radiotelephones, which is based on the GSM standard, operates in the range of 900 MHz with 992 channels, with 124 frequencies with 8 channels each being employed in time-division multiplex. The channel grid amounts to 200 KHz. In the same way, the E-mobile radiotelephone network, which is based on the DCS1800 standard similar to the GSM, also uses predefined frequency bands in the range of 1800 MHz. Further, the analogous American AMPS system operates with 666 channels and 30 KHz channel spacing in the 800 MHz range.

The noises that are emitted into the hearing aid device are then utilized for determining whether the patient is telephoning with a mobile telephone. Since the interfering noise signal drops with increasing distance between the mobile telephone and the hearing aid device, threshold analysis can unambiguously decide whether there is an active telephone system in the proximity of the hearing aid device.

Despite careful shielding measures, electromagnetic interference proceeds into the hearing aid device, as is known from the EMC problem in hearing systems. This interference is so high that the standard packet rates can be directly detected as noises. Such noise signals are therefore also suited for further processing. In order to improve the reception of these specific noise signals, the shieldings could by correspondingly redesigned, or specific antennas could be provided for the noise signal. Such an antenna then works as a further pick-up in addition to the microphones 2, 3 and the induction coil 4. It s output signal can be correspondingly employed for the control of the hearing aid device.

It is apparent from the above discussion that noises that are caused by wireless telephone systems lie in a great number of frequency ranges. Thus, for example, the high carrier frequencies of the transmission signals, or the comparatively low-frequency, characteristic signal patterns with which the data packets are transmitted, can be evaluated.

The direct detection of an interfering carrier signal arising from a mobile telephone can ensue by means of narrowband signal detection. The carrier signals emitted into the hearing aid device in the respectively typical spectral range can be recognized with a level meter.

As already indicated, another possibility for detecting the proximity of a mobile telephone to the hearing aid device is to detect characteristic signal patterns, particularly the disturbances produced by the data packets.

In this case, the electromagnetic interference is modulated with the transmission rate of the data packets. These modulations can be recognized in the signal processing of the hearing aid devices and often can be perceived as interference in the audio domain. For example, a narrowband filtering for noise signals with the packet frequency would provide an unambiguous indication of existing DECT fields at the hearing aid when their intensity exceeds a limit value. As soon as the intensity of this noise field drops again, it can be assumed that the radiotelephone has been moved away from the hearing aid or that the telephone call has ended.

Figure 3:
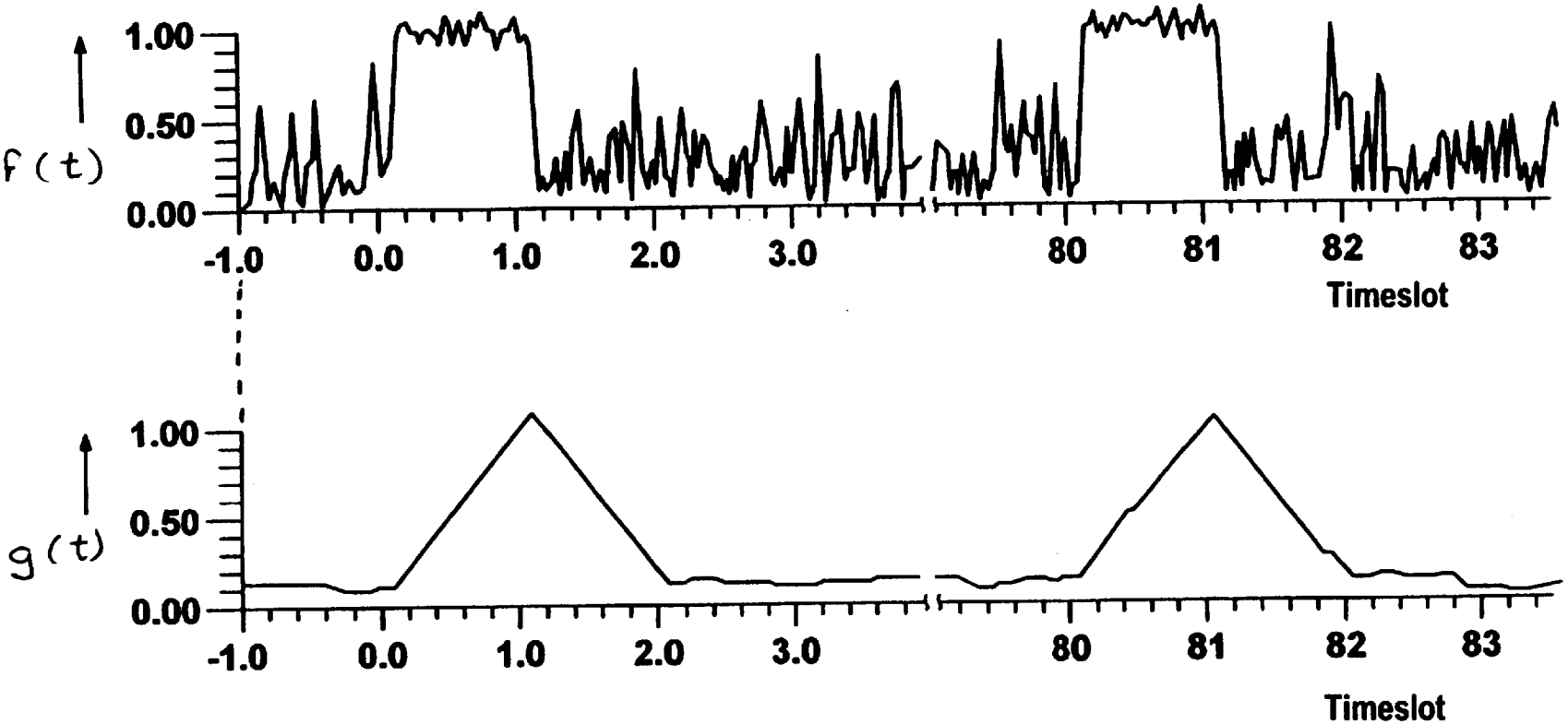
FIG. 3 shows the signal shapes of pre-processed noise signals.

FIG. 3, top, shows a typical signal curve f(t) of a noise signal of a type produced by a timeslot-oriented radiotelephone system. The amplitude boosts in the timeslots 0 and 80 can be unambiguously recognized. The function curve g(t) in FIG. 3, bottom, shows the auditory signal that is further-processed for evaluation. An unambiguous detection of interfering data packet signals can be achieved with a level measurement but also by an analysis of the signal shape, a characteristic triangular signal shape in this example, and other evaluation methods.

The hearing aid device can be switched or controlled on the basis of the characteristic noise signals. Individual hearing aid parameters thus can be automatically modified given detection of characteristic noise signals. For example, the hearing aid device can be switched into a prescribed gain when it is recognized that the hearing aid wearer is telephoning with a mobile telephone. Likewise, the filter bandwidth of the hearing aid device can be reduced when the hearing aid device registers telephoning with a cordless telephone.

In addition to the control of individual parameters, a number of parameters that are combined into hearing programs can be simultaneously modified by switching from one hearing program into another. Thus, for example, the hearing aid device can be switched from a hearing program for directional hearing into a hearing program for omnidirectional hearing when the hearing aid device recognizes the proximity of a telephone device.

The use of noise signals for the control and switching of hearing aid devices is not limited only to the area of mobile telephones. It is also possible for the hearing aid device to switch into a suitable hearing program given detection of noise signals that are produced by digital television, music transmission from headphones and the like.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing aid comprising:

an acousto-electrical transducer for picking up an incoming acoustical signal and for converting said acoustical signal into an electrical signal;

a control device supplied with said electrical signal for processing said electrical to produce a processed signal, including analyzing said electrical signal to detect a noise signal therein originating from externally interfering electromagnetic disturbances, and thereby obtaining an analysis result and automatically setting at least one control parameter selected from the group of transmission parameters and acoustic programs, dependent on said analysis result; and an electro-acoustical transducer supplied with said processed signal for producing an acoustic output therefrom.

2. A hearing aid as claimed in claim 1 wherein said control device analyzes said acoustic electrical signal dependent on at least one of a type and an extent of said noise signal.

3. A hearing aid as claimed in claim 1 wherein said control device analyzes said electrical signal dependent on at least one of level, carrier frequency, modulation frequency, degree of modulation and signal-to-noise ratio.

4. A hearing aid as claimed in claim 1 wherein said acousto-electrical transducer is a microphone and wherein said acoustical signal is an audio signal.

5. A hearing aid as claimed in claim 1 wherein said control device analyzes said electrical signal in respective frequency bands.

6. A hearing aid as claimed in claim 1 wherein said control device analyzes said electrical signal by comparison of said noise signal to predetermined signal patterns.

7. A hearing aid as claimed in claim 6 wherein said control device analyzes said electrical signal by comparison to predetermined signal patterns respectively representing data packet transmission by different wireless transmission systems.

8. A hearing aid as claimed in claim 1 wherein said control device analyzes said electrical signal to determine if said noise signal has a signal pattern representative of data packets of a mobile telephone terminal and, if so, processes said electrical signal according to a telephone hearing program.

9. A method for operating a hearing aid comprising the steps of:

picking up an incoming acoustical signal and converting said acoustical signal into an electrical signal;

processing said electrical to produce a processed signal, including analyzing said electrical signal to detect a noise signal therein originating from external electromagnetic disturbances, and thereby obtaining an analysis result and automatically setting at least one control parameter selected from the group of transmission parameters and acoustic programs, dependent on said noise signal; and producing an acoustic output from said processed signal.

10. A method as claimed in claim 9 comprising analyzing said electrical signal dependent on at least one of a type and an extent of said noise signal.

11. A method aid as claimed in claim 9 comprising analyzing said electrical signal dependent on at least one of level, carrier frequency, modulation frequency, degree of modulation and signal-to-noise ratio.

12. A method as claimed in claim 9 comprising analyzing said electrical signal in respective frequency bands.

13. A method as claimed in claim 9 comprising analyzing said electrical signal by comparing said signal to predetermined signal patterns.

14. A method as claimed in claim 13 comprising analyzing said electrical signal by comparison to predetermined signal patterns respectively representing data packet transmission by different wireless transmission systems.

15. A method as claimed in claim 9 comprising analyzing said noise content to determine if said noise signal has a signal pattern representative of data packets of a mobile telephone terminal and, if so, processing said electrical signal according to a telephone hearing program.

* * * * *